US011988054B2

(12) United States Patent
Roselier et al.

(10) Patent No.: US 11,988,054 B2
(45) Date of Patent: May 21, 2024

(54) SYSTEM AND METHOD UTILIZING BALL SEAT WITH LOCKING FEATURE

(71) Applicant: Schlumberger Technology Corporation, Sugar Land, TX (US)

(72) Inventors: Samuel Roselier, Bruz (FR); Romain Neveu, Bruz (FR); Julie Leduc, Bruz (FR); Francois Bajart, Bruz (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 80 days.

(21) Appl. No.: 17/905,689

(22) PCT Filed: Mar. 5, 2021

(86) PCT No.: PCT/US2021/021030
§ 371 (c)(1),
(2) Date: Sep. 6, 2022

(87) PCT Pub. No.: WO2021/183379
PCT Pub. Date: Sep. 16, 2021

(65) Prior Publication Data

US 2023/0084218 A1 Mar. 16, 2023

(30) Foreign Application Priority Data

Mar. 13, 2020 (EP) ..... 20305260

(51) Int. Cl.
*E21B 23/04* (2006.01)

(52) U.S. Cl.
CPC ..... *E21B 23/0413* (2020.05)

(58) Field of Classification Search
CPC ..... E21B 23/04; E21B 23/0413
See application file for complete search history.

(56) References Cited

U.S. PATENT DOCUMENTS 3,552,412 A * 1/1971 Hagar ..... E21B 21/103 166/194
5,146,992 A 9/1992 Baugh
(Continued)

FOREIGN PATENT DOCUMENTS

| | | | |
|---|---|---|---|
| CN | 204060645 | U | 12/2014 |
| WO | 9848143 | A1 | 10/1998 |
| WO | 2017052510 | A1 | 3/2017 |

OTHER PUBLICATIONS

International Search Report and Written Opinion issued in the PCT Application PCT/US2021/021030, dated Jun. 18, 2021 (11 pages).

*Primary Examiner* — Shane Bomar
(74) *Attorney, Agent, or Firm* — Jeffrey D. Frantz

(57) ABSTRACT

A technique facilitates pressure application downhole by locking a ball in place to prevent it from unseating even if the pressure is bled off. A ball seat is constructed with a locking feature for effectively capturing and retaining the ball once the ball is seated in the ball seat under sufficient pressure. According to an embodiment, the ball seat may be mounted at a desired position along an internal flow passage of a well string component. The ball seat comprises a throat section which is formed of a ductile material arranged in a suitable structure to enable a desired deformation upon receiving the ball under sufficient pressure. As the ball is pressed into the throat section, the material of the throat section deforms and partially springs back to resist movement of the ball in the uphole direction, thus capturing the ball in both the uphole direction and the downhole direction.

20 Claims, 5 Drawing Sheets

(56) References Cited

U.S. PATENT DOCUMENTS

| | | | | |
|---|---|---|---|---|
| 2010/0032151 | A1 | 2/2010 | Duphorne | |
| 2011/0061856 | A1 | 3/2011 | Kellner et al. | |
| 2013/0146308 | A1* | 6/2013 | Saltel | E21B 29/10 166/208 |
| 2014/0166292 | A1 | 6/2014 | Crowley | |
| 2016/0177656 | A1* | 6/2016 | Streich | E21B 23/0413 166/193 |
| 2016/0362962 | A1 | 12/2016 | Gonzalez | |
| 2017/0122441 | A1 | 5/2017 | Adam | |
| 2018/0119509 | A1 | 5/2018 | Hered et al. | |
| 2018/0148993 | A1 | 5/2018 | Schmidt et al. | |
| 2018/0230765 | A1 | 8/2018 | Crump et al. | |
| 2018/0238133 | A1* | 8/2018 | Fripp | E21B 33/1293 |
| 2019/0271204 | A1 | 9/2019 | Watson et al. | |
| 2022/0081984 | A1* | 3/2022 | Roselier | E21B 23/0413 |
| 2022/0090457 | A1* | 3/2022 | Tanguy | E21B 43/108 |
| 2023/0203912 | A1* | 6/2023 | Zhong | E21B 33/128 166/123 |

* cited by examiner

SYSTEM AND METHOD UTILIZING BALL SEAT WITH LOCKING FEATURE

CROSS-REFERENCE TO RELATED APPLICATIONS

This application is a National Stage Entry of International Application No. PCT/US2021/021030, filed Mar. 5, 2021.

BACKGROUND

In many well applications, a wellbore is drilled into a subterranean formation and subsequently completed with completion equipment to facilitate production of desired well fluids, e.g. oil and gas, from a reservoir. Sometimes the completion equipment includes tools which are actuated hydraulically via pressure applied downhole. The pressure actuation may involve moving a ball downhole along an interior of well tubing and into sealed engagement with a corresponding ball seat. This allows pressure to be increased along the interior of the tubing for performing desired functions, e.g. actuating a downhole device or conducting a cementing operation. However, when the ball is in a highly deviated section, e.g. a horizontal section, of the wellbore the ball may unseat if pressure uphole of the ball is bled off.

SUMMARY

In general, a system and methodology are provided to facilitate pressure application downhole by locking a ball, e.g. a non-deformable ball, in place to prevent it from unseating even if the pressure is bled off. A ball seat is constructed with a locking feature for effectively capturing and retaining the ball once the ball is seated in the ball seat under sufficient pressure. According to an embodiment, the ball seat may be mounted at a desired position along an internal flow passage of a well string component. The ball seat comprises a throat section which is formed of a ductile material arranged in a suitable structure to enable a desired deformation upon receiving the ball under sufficient pressure. As the ball is pressed into the throat section, the material of the throat section deforms but also partially springs back to resist movement of the ball in the uphole direction, thus capturing the ball in both the uphole direction and the downhole direction.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
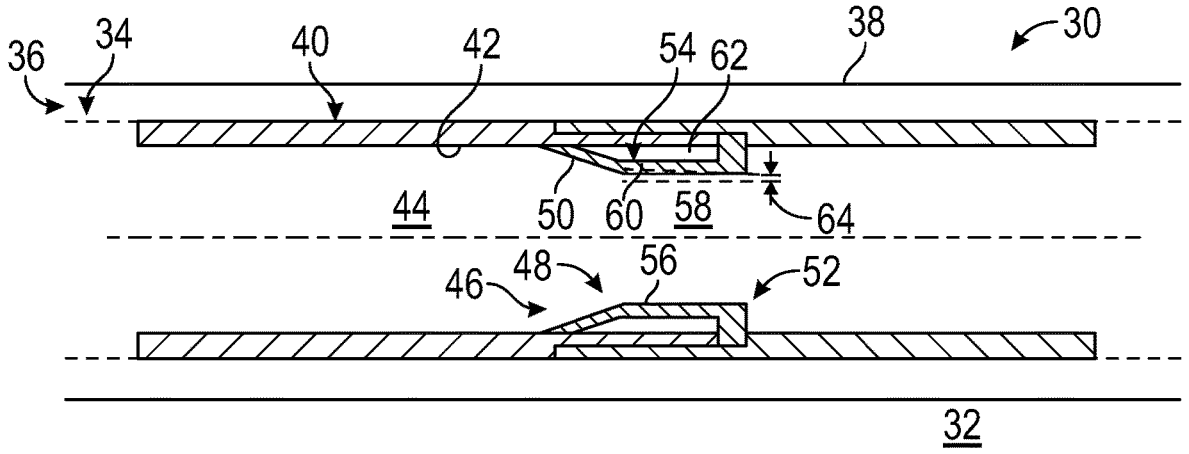
FIG. 1 is a schematic cross-sectional illustration of a well string deployed in a borehole and having a tubular section in which is mounted an example of a ball seat, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for facilitating pressure application downhole. In well applications, well strings may be deployed downhole into a borehole, e.g. a wellbore, with completion equipment and/or other downhole equipment. The downhole equipment may comprise various types of tools which are selectively actuated hydraulically via pressure applied downhole through the well string. Examples of such hydraulically actuated tools include sliding sleeve devices which may be in the form of stage cementing collar sleeves, circulation port sleeves, fracturing sleeves, and/or other hydraulically actuated devices.

The increased pressure applied to actuate the desired downhole device or devices may be enabled by locking a ball in sealed engagement with a ball seat to prevent it from unseating even if the pressure is bled off. According to an embodiment, the ball seat may be constructed with a locking feature for effectively capturing and retaining the ball once the ball is seated in the ball seat under sufficient pressure. The ball seat may be mounted at a desired position along an internal flow passage of a well string/well string component. Additionally, the ball seat may comprise a throat section which is formed of a ductile material arranged in a suitable structure to enable a desired deformation upon receiving the ball under sufficient pressure. The arrangement of structure and material enables use of a non-deformable ball without detrimentally affecting the locking capability of the ball seat. As the ball is pressed into the throat section, the material of the throat section deforms but also partially springs back to resist movement of the ball in the uphole direction. Consequently, the ball is captured via the ball seat and locked against movement in both the uphole direction and the downhole direction.

As described in greater detail below, the throat section of the ball seat may be mounted between a ball entrance portion and a base portion in some embodiments. The ball entrance portion may have a variety of configurations to help guide the ball into the throat section which is deformed as the ball is moved through the ball entrance portion and forced into the throat section. The throat section has a diameter less than the diameter of the ball. Due to the structure and deformability of the throat section, the ball may be formed of a non-deformable material, such as aluminum alloy, aluminum bronze, phenolic, or other suitable material.

A non-deformable ball may be considered a ball which compresses less than 2% in diameter (and in some embodiments less than 1%) as it is forced into the throat section under pressure applied down through the well string. It also should be noted that the terms "ball" or "non-deformable ball" are used broadly to refer to items able to block flow along an internal passage. References made herein to "ball" or "non-deformable ball" are meant to include many types of devices having a variety of shapes and configurations, e.g. partial balls, darts, and various other plugs which may seal against a ball seat.

Depending on the parameters of a given application, the throat section may be formed of a ductile material which plastically deforms as the ball is forced into the throat section. In other words, the throat section is forced into a radially outward, expanded configuration by the ball to an extent which plastically deforms the material of the throat section. However, the ductile material is selected with sufficient spring back so that a portion of the throat section on an uphole side of the ball effectively springs back after passage of the ball. The spring back allows this portion of the throat section to transition back to a smaller diameter and thus trap the ball between a reduced radius (relative to the ball radius) on both an uphole side and downhole side of the ball. Accordingly, pressure may be released uphole of the ball without concern that the ball will become unseated with respect to the ball seat even in highly deviated, e.g. horizontal, boreholes.

Examples of ductile material which may be used to construct the throat section include aluminum alloys or steel alloys selected to have appropriate plastic deformability and sufficient spring back to capture the ball. In some embodiments, the throat section may be made out of the same material as the ball entrance portion and the base portion. However, the overall ball seat may be formed with multiple materials, e.g. composite materials. Use of certain materials e.g. aluminum alloys, helps ensure that the ball seat is drillable so that it may be drilled out after its use is completed.

Referring generally to FIG. 1, an example of a well system 30 is illustrated for use in a downhole well application. For example, the well system 30 may be used in producing a well fluid, e.g. oil, from a subterranean formation 32. According to an embodiment, the well system 30 comprises a well string 34 sized for deployment along a borehole 36, e.g. a wellbore. In various applications, the borehole 36 may comprise a highly deviated, e.g. horizontal, borehole section 38 into which the well string 34 is deployed. In the illustrated example, the well string 34 may comprise a tubular section 40, e.g. a tubular well component, having an interior surface 42 defining an internal flow passage 44.

Additionally, a ball seat 46 may be mounted in the well string 34 along the internal flow passage 44 within tubular section 40. By way of example, the ball seat 46 may be generally circular in cross-section extending about the interior of tubular section 40. In some embodiments, the ball seat 46 may comprise a ball entrance portion 48 having a sloped surface 50 which slopes radially inwardly from interior surface 42 and in a generally downhole direction. As illustrated, the ball seat 46 also may comprise a base portion 52. In the example illustrated, the base portion 52 securely mounts and seals the ball seat 46 to the tubular section 40. However, the ball entrance portion 48 and/or other portions of ball seat 46 may be used to secure the ball seat 46 to the tubular section 40.

Furthermore, the ball seat 46 may comprise a throat section 54 extending between the ball entrance portion 48 and the base portion 52. An interior surface 56 of the throat section 54 defines an internal throat passage 58 which has a diameter smaller than the diameter of interior surface 42 and smaller than the diameter of a ball used to block flow along internal flow passage 44, as explained in greater detail below. In some embodiments, the throat section 54 is constructed with a wall 60 which extends from ball entrance portion 48 to base portion 52 at a radially inward position from interior surface 42 so as to form a space 62 between the interior surface 42 and the throat section 54.

According to some examples, the throat section 54 may be constructed such that interior surface 56 is cylindrical. In other applications, however, the throat section 54 may be constructed such that interior surface 56 has other profiles. For example, the interior surface 56 may be constructed with a sloped profile which tapers to a smaller diameter in a downhole direction as indicated by angle 64. By way of example, the angle 64 may be less than 10°, e.g. in the range of 1-3°. It should be noted that throat section 54 may be constructed in a variety of configurations and may be utilized with various types of support structures, e.g. various types of base portions 52, and with various types of entrance portions 48. As explained in greater detail below, the throat section 54 is constructed to effectively serve as a locking feature which locks a ball in sealing engagement with the ball seat 46.

Figure 2:
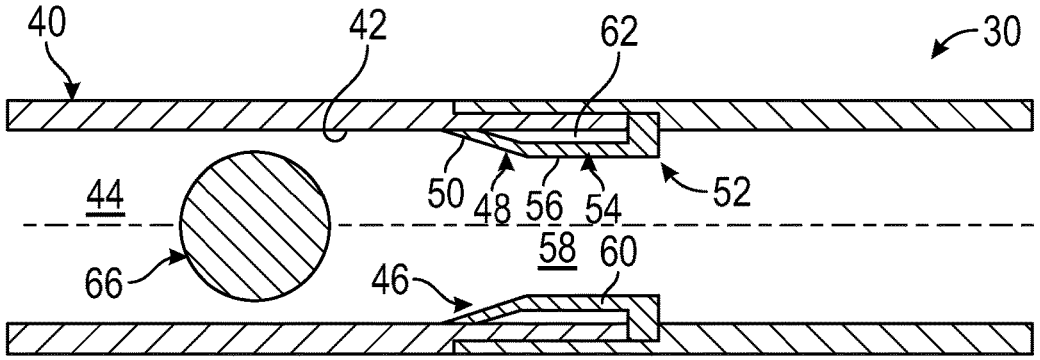
FIG. 2 is a schematic cross-sectional illustration of the tubular section and ball seat illustrated in FIG. 1 as a ball approaches the ball seat, according to an embodiment of the disclosure.
Figure 3:
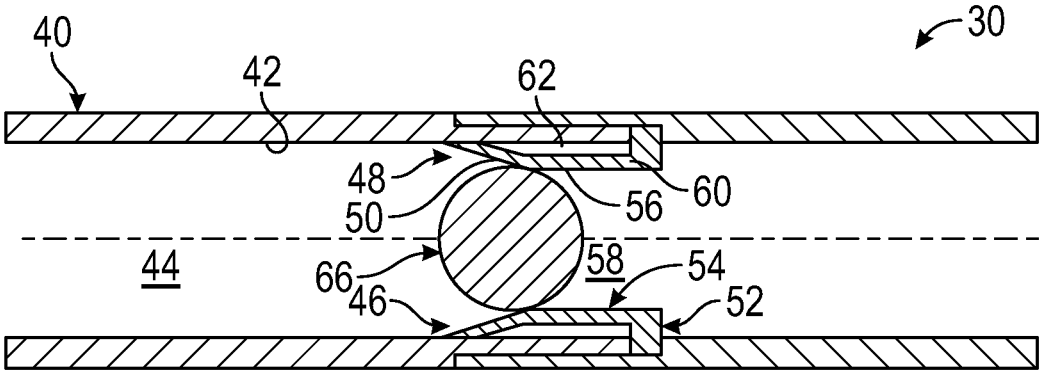
FIG. 3 is a schematic cross-sectional illustration of the tubular section and ball seat illustrated in FIG. 2 as the ball enters the ball seat, according to an embodiment of the disclosure.

Referring generally to FIG. 2, an illustration is provided in which a ball 66 is dropped, e.g. pumped, down through an interior of the well string 34 and along internal flow passage 44 toward ball seat 46. In this example, ball 66 is a non-deformable ball having a diameter larger than the diameter of internal throat passage 58. When the ball 66 reaches ball seat 46, it is guided to internal throat passage 58 via the sloped surface 50 of ball entrance portion 48 as illustrated in FIG. 3.

Figure 4:
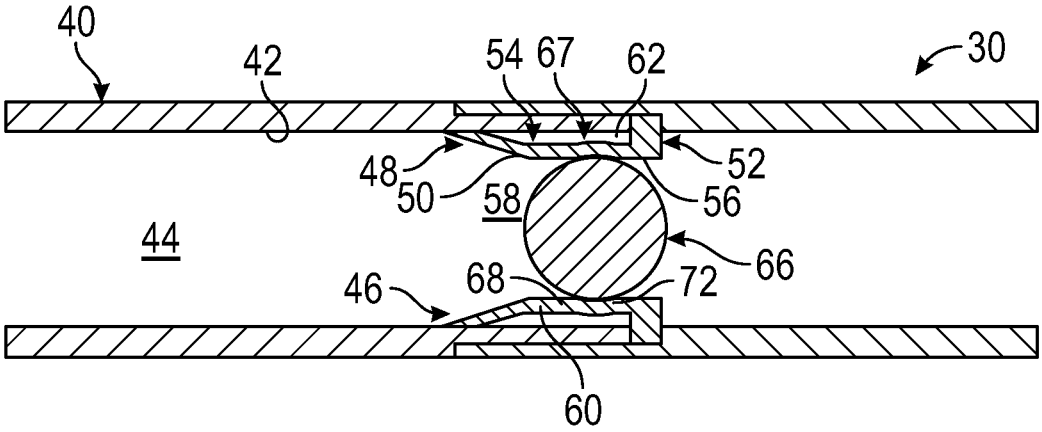
FIG. 4 is a schematic cross-sectional illustration of the tubular section and ball seat illustrated in FIG. 3 as the ball is forced into a throat section of the ball seat to create a deformation which secures the ball, according to an embodiment of the disclosure.

As the ball 66 enters internal throat passage 58, flow along internal flow passage 44 is blocked so that the pressure uphole of ball 66 may be increased. The increased pressure is used to force ball 66 along internal throat passage 58 and into throat section 54 as illustrated in FIG. 4. The material and structure of throat section 54 may be selected to enable movement of ball 66 into throat section 54 under a desired pressure application along internal flow passage 44.

By way of example, the pressure applied to shift ball 66 into throat section 54, as illustrated in FIG. 4, may be in the range of 1000 psi (pounds per square inch) to 10,000 psi. In some applications, the pressure applied to shift ball 66 into throat section 54 is selected from within the range of 1000 psi to 5000 psi. However, other suitable pressures or pressure ranges may be selected for shifting ball 66 to a locked position in throat section 54 depending on the materials and configuration of ball seat 46.

Figure 5:
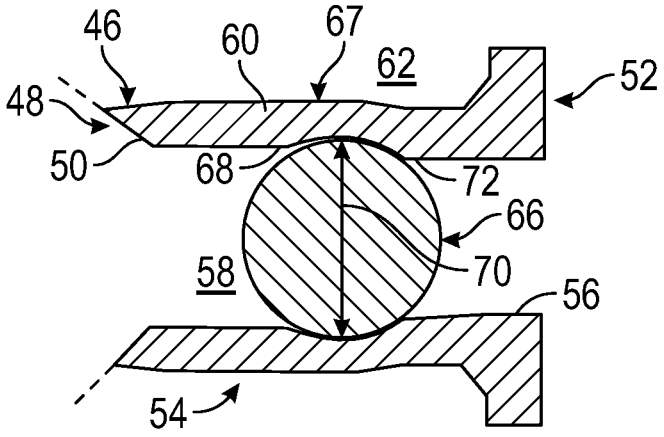
FIG. 5 is an enlarged illustration of the ball seat once the ball has been forced into the throat section to create the desired deformation, according to an embodiment of the disclosure.

In the illustrated example, ball 66 is constructed from a non-deformable material and throat section 54 is constructed from a ductile material, e.g. an aluminum alloy, which deforms as ball 66 moves into throat section 54 to create a region of deformation 67 (see also FIG. 5). For example, wall 60 of throat section 54 may deform in a radially outward direction. However, the ductile material has sufficient spring back such that an uphole portion 68 of throat section 54 springs back to a relatively smaller diameter (compared to a diameter 70 of ball 66) to prevent the ball 66 from shifting back in an uphole direction. Simultaneously, movement of the ball 66 into throat section 54 and the resultant deformation of throat section 54 creates a downhole portion 72 which remains at a relatively smaller diameter compared to diameter 70 of ball 66. The downhole portion 72 may be buttressed by base 52. As a result, the ball 66 is trapped and restricted from further movement in either an uphole direction or a downhole direction even after pressure has been released in internal flow passage 44. The portions 68, 72 effectively serve as a locking feature to lock ball 66 in seated engagement with throat section 54.

In various embodiments, the material of throat section 54 is selected to undergo plastic deformation as ball 66 is forced along internal throat passage 58 into throat section 54. The plastic deformation in, for example, deformation region 67 is useful in ensuring retention of the ball 66. However, the material of throat section 54 retains sufficient spring back to enable creation of uphole portion 68 after passage of ball 66, thus trapping the ball 66.

In a specific example, movement of a non-deformable ball 66 into throat section 54 causes radial expansion of the throat section wall 60 into space 62 to a sufficient degree that the material of throat section 54 undergoes plastic deformation. At the same time, however, the downhole portion 72 remains and the uphole portion 68 is created via the spring back of the throat material. Consequently, the ball 66 becomes trapped and effectively locked against movement downhole via portion 72 or uphole via portion 68 even when pressure in well string 34 is released. In some embodiments, the base portion 52 of ball seat 46 is formed as a non-expandable section having a smaller inside diameter than the diameter 70 of ball 66 so as to ensure downhole portion 72 remains to resist movement of ball 66 past the ball seat 46.

Figure 6:
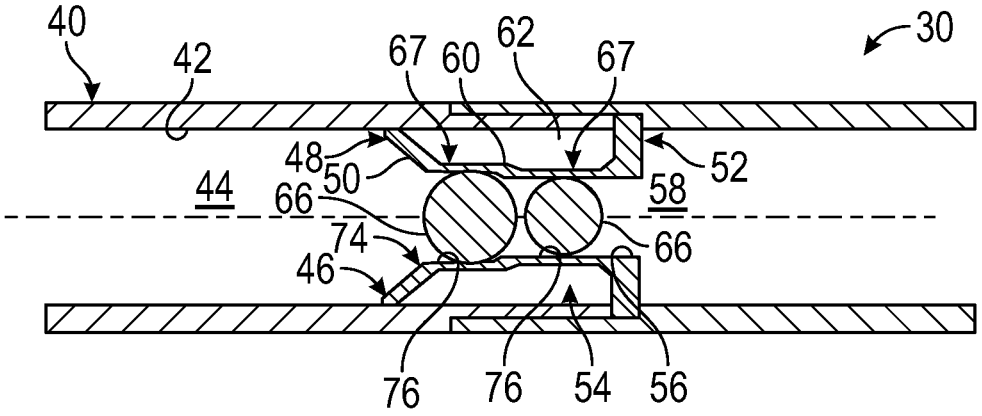
FIG. 6 is a schematic cross-sectional illustration of another example of a ball seat deployed along a tubular section of a well string, according to an embodiment of the disclosure.

Referring generally to FIG. 6, another embodiment of ball seat 46 is illustrated. In this example, the throat section 54 is constructed to facilitate the capture and retention of a plurality of balls 66, e.g. two balls 66, along the interior surface 56. As illustrated, the throat section 54 is constructed with a plurality of different diameters which are each slightly smaller than the diameter of the corresponding ball 66 to be captured and locked in place.

With this type of throat section 54, the interior surface 56 may be constructed with a stepped profile 74 which has a plurality of steps 76 to establish appropriate diameters for capturing balls of different diameters. According to the example illustrated, the steps 76 are constructed to capture two differently sized balls 66, but additional steps 76 may be added for capturing additional balls 66. The plurality of differently sized balls 66 which may be seated enables a plurality of sequential pressure applications separated by flow through capability.

Accordingly, the throat section 54 may be constructed to enable application of sufficient pressure to force at least the initial ball through the ball seat 46 to enable flow along internal flow passage 44. Subsequently, the flow along passage 44 may again be blocked by dropping another ball 66 (a larger diameter ball) for engagement with a larger diameter step 76. Each step 76 is able to deform, e.g. plastically deform, and form its own deformation region 67 for locking in place the corresponding ball 66.

Figure 7:
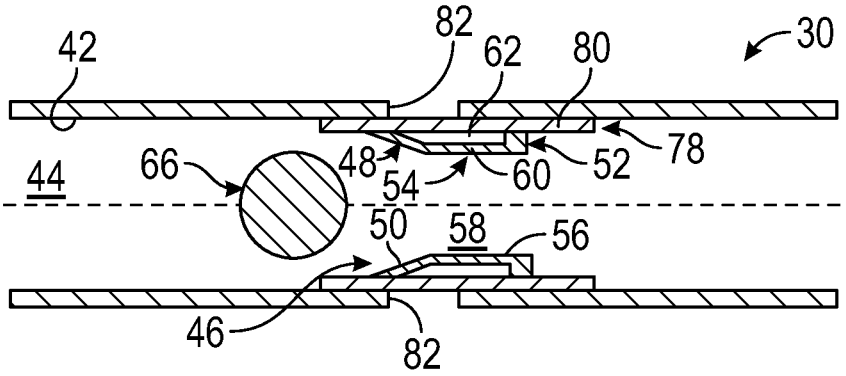
FIG. 7 is a schematic cross-sectional illustration of another example of a well string component working in cooperation with the ball seat, according to an embodiment of the disclosure.
Figure 8:
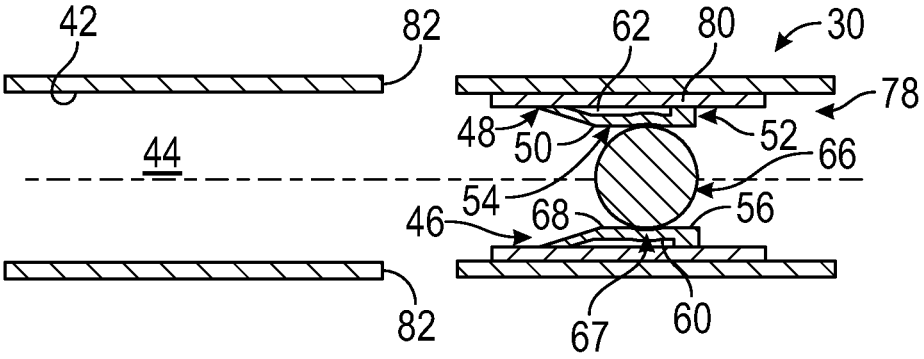
FIG. 8 is a schematic cross-sectional illustration similar to that of FIG. 7 but showing the well string component in a different operational position, according to an embodiment of the disclosure.

Referring generally to FIGS. 7 and 8, another embodiment is illustrated in which the ball seat 46 is used in conjunction with a specific downhole tool 78. By way of example, the downhole tool 78 may comprise a sliding sleeve 80 which may be shifted to different operational positions via application of pressure in internal flow passage 44. In some embodiments, the ball seat 46 may be used in cooperation with ball 66, as described above, to enable application of pressure along the interior of well string 34 so as to actuate a suitable hydraulic piston for shifting the sliding sleeve 80 (or other type of actuatable downhole tool 78).

In the illustrated example, however, the ball seat 46 is mounted to the sliding sleeve 80 along the interior of sliding sleeve 80. When ball 66 is seated and locked in throat section 54, pressure may be increased along the interior of the well string 34 to enable shifting of the sliding sleeve 80 in a downhole direction. The ball seat 46 and ball 66 are simply shifted along with the sliding sleeve 80. For example, the sliding sleeve 80 may be shifted from a closed position (see FIG. 7) to an open position (see FIG. 8) allowing flow through one or more side ports 82 in tubular section 40. In this example, the side ports 82 extend through a wall forming tubular section 40 to enable fluid communication between an exterior and an interior of the tubular section 40.

Figure 9:
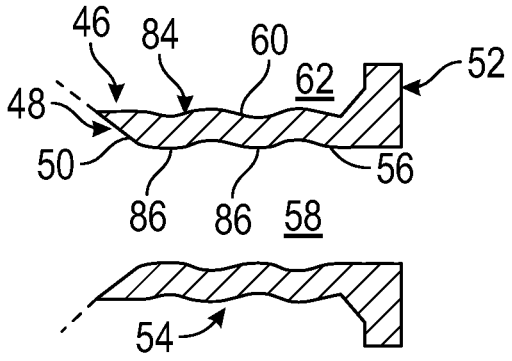
FIG. 9 is a schematic cross-sectional illustration of another example of a ball seat, according to an embodiment of the disclosure.
Figure 10:
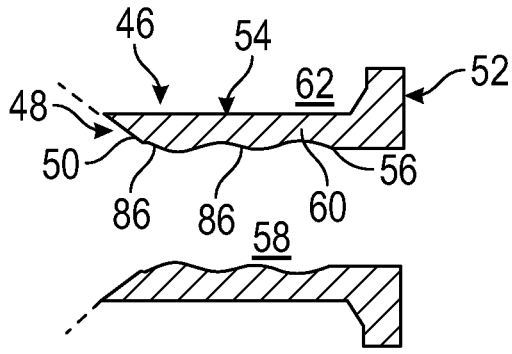
FIG. 10 is a schematic cross-sectional illustration of another example of a ball seat, according to an embodiment of the disclosure.

Referring generally to FIG. 9, another embodiment of ball seat 46 is illustrated. In this example, the ball seat 46 comprises wall 60 of throat section 54 formed as a corrugated pipe 84. The corrugated pipe 84 provides interior surface 56 with corrugations/undulations 86 oriented to help grip the ball 66. In a similar embodiment, the wall 60 is not formed as a corrugated pipe with corrugations on both an interior and an exterior but instead simply provides the corrugations/undulations 86 along interior surface 56, as illustrated in FIG. 10.

Figure 11:
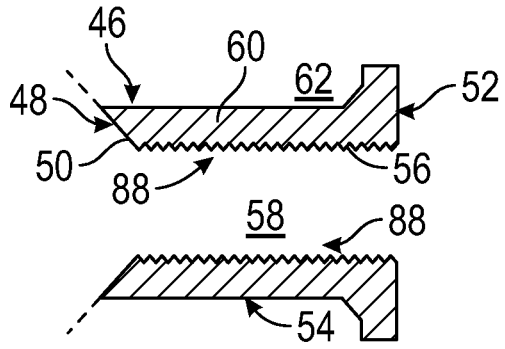
FIG. 11 is a schematic cross-sectional illustration of another example of a ball seat, according to an embodiment of the disclosure.
Figure 12:
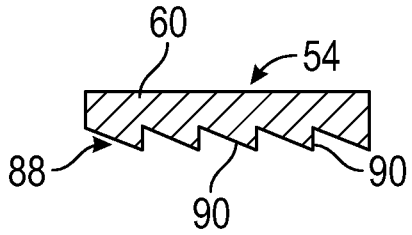
FIG. 12 is an illustration of an example of an interior surface of a ball seat having teeth, according to an embodiment of the disclosure.
Figure 13:
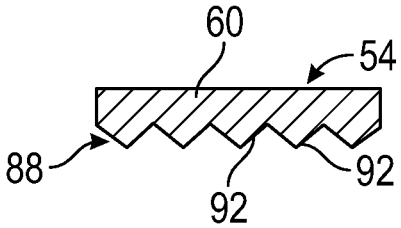
FIG. 13 is an illustration of another example of an interior surface of a ball seat having teeth, according to an embodiment of the disclosure.

Referring generally to FIG. 11, another embodiment of ball seat 46 is illustrated as having interior surface 56 of throat section 54 formed with teeth 88. The teeth 88 may be arranged along the interior of throat section 54 to facilitate gripping of ball 66. Teeth 88 may be constructed in various patterns, sizes and configurations depending on the parameters of a given application. By way of example, teeth 88 may have an asymmetrical profile 90, e.g. an asymmetrical triangular profile, as illustrated in FIG. 12. According to another example, the teeth 88 may have a symmetrical profile 92, e.g. a symmetrical triangular profile, as illustrated in FIG. 13. However, teeth 88 may be formed in various other symmetrical and asymmetrical shapes and configurations.

Depending on the parameters of a given application, environment, and equipment utilized, the ball seat 46 may be used as part of various types of completion equipment or other downhole equipment. In a variety of applications, the ball seat 46 is constructed to plastically deform as a non-deformable ball 66 is forced into the ball seat throat section 54 while allowing sufficient spring back to capture the ball. This allows the use of a conventional, non-deformable ball 66. However, various other types of balls, including deformable balls, can be used with the ball seat 46 for at least some applications.

The ball seat 46 may be a fixed element in a tubular section, e.g. a liner, or it may be mounted as part of a sliding sleeve or other shiftable component. Additionally, the ball seat 46 may be constructed from various aluminum alloys, composite materials, and/or other materials which provide the capability for plastic deformation and sufficient spring back. The specific alloys/materials selected may vary depending on the environment in which the ball seat 46 is used, the type of corresponding equipment, and the pressures to be applied for a given operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well string sized for deployment along a borehole, the well string having a tubular section with an interior surface defining an internal flow passage; and a ball seat mounted in the well string along the internal flow passage, the ball seat comprising:

a ball entrance sloping radially inwardly from the interior surface;

a base; and a throat section having an interior throat surface which tapers to a smaller diameter in a downhole direction, the throat section extending between the ball entrance and the base to form a space between the interior surface and the throat section, the throat section being formed of a ductile material which is plastically deformable such that the throat section expands radially outwardly when receiving a ball with a larger diameter than the throat section, the ductile material having sufficient spring back to capture the ball on both an uphole side and a downhole side.

2. The system as recited in claim 1, wherein the throat section is formed of a metal material.

3. The system as recited in claim 1, wherein the throat section is formed of an aluminum alloy material.

4. The system as recited in claim 1, wherein the throat section is formed of a steel alloy material.

5. The system as recited in claim 1, wherein the throat section is plastically deformed to capture a ball when pressure is applied along the internal flow passage in the range of 1000-10,000 psi.

6. The system as recited in claim 1, wherein the base securely mounts and seals the ball seat to the tubular section and further wherein the base is non-expandable.

7. The system as recited in claim 1, wherein the ball seat is mounted along a sliding sleeve.

8. A method, comprising:

providing a ball seat comprising a ball entrance, a base, and a throat section;

mounting the ball seat within a tubular well string component such that the throat section is spaced radially inward from an interior surface of the tubular well string component, the throat section having an interior throat surface which tapers to a smaller diameter in a downhole direction, the throat section extending between the ball entrance and the base to form a space between the interior surface and the throat section, the throat section being formed of a ductile material which is plastically deformable such that the throat section expands radially outwardly when receiving a non-deformable ball with a larger diameter than the throat section, the ductile material having sufficient spring back to capture the non-deformable ball on both an uphole side and a downhole side, and the ball entrance sloping radially inwardly from the interior surface;

deploying the tubular well string component downhole in a borehole; and pumping the non-deformable ball down into the ball seat and into the throat section until the throat section deforms to capture the non-deformable ball by blocking further movement in both an uphole direction and the downhole direction.

9. The method as recited in claim 8, wherein pumping the non-deformable ball down into the ball seat comprises applying sufficient pressure along the interior of the tubular well string component to plastically deform the throat section while allowing sufficient spring back of at least an uphole portion of the throat section to capture the non-deformable ball.

10. A system for use in a well, comprising:

a well string sized for deployment along a borehole, the well string having a tubular section with an interior surface defining an internal flow passage; and a ball seat mounted in the well string along the internal flow passage, the ball seat comprising:

a ball entrance sloping radially inwardly from the interior surface;

a base; and a throat section having an interior throat surface which is stepped to provide different diameters for capturing differently sized balls, the throat section extending between the ball entrance and the base to form a space between the interior surface and the throat section, the throat section being formed of a ductile material which is plastically deformable such that the throat section expands radially outwardly when receiving a ball with a larger diameter than the throat section, the ductile material having sufficient spring back to capture the ball on both an uphole side and a downhole side.

11. The system as recited in claim 10, wherein the throat section is formed of a metal material.

12. The system as recited in claim 10, wherein the throat section is formed of an aluminum alloy material.

13. The system as recited in claim 10, wherein the throat section is formed of a steel alloy material.

14. The system as recited in claim 10, wherein the throat section is plastically deformed to capture a ball when pressure is applied along the internal flow passage in the range of 1000-10,000 psi.

15. The system as recited in claim 10, wherein the base securely mounts and seals the ball seat to the tubular section and further wherein the base is non-expandable.

16. The system as recited in claim 10, wherein the ball seat is mounted along a sliding sleeve.

17. The method as recited in claim 8, wherein the throat section is formed of a metal material.

18. The method as recited in claim 8, wherein the throat section is formed of an aluminum alloy material.

19. The method as recited in claim 8, wherein the throat section is formed of a steel alloy material.

20. The method as recited in claim 8, wherein the base is non-expandable.

* * * * *